US005722484A

United States Patent [19]

Subramanian et al.

[11] Patent Number: 5,722,484

[45] Date of Patent: Mar. 3, 1998

[54] LOUVER ASSEMBLY FOR FAN DISCHARGE DUCT

[75] Inventors: Srinivasan Subramanian, Liverpool; Peter R. Bushnell, Cazenovia, both of N.Y.

[73] Assignee: Carrier Corporation, Syracuse, N.Y.

[21] Appl. No.: 578,793

[22] Filed: Dec. 26, 1995

[51] Int. Cl.[6] ..... F24F 13/10

[52] U.S. Cl. ..... 165/96; 165/122; 165/DIG. 92; 165/DIG. 311

[58] Field of Search ..... 165/96, 122; 454/313, 454/316, 321

[56] References Cited

U.S. PATENT DOCUMENTS

| | | | |
|---|---|---|---|
| 2,324,858 | 7/1943 | Levine | 454/321 |
| 2,759,411 | 8/1956 | Jenson | 454/316 |
| 5,072,878 | 12/1991 | Aoki et al. | 236/38 |

FOREIGN PATENT DOCUMENTS

| | | | |
|---|---|---|---|
| 60-243439 | 12/1985 | Japan | 454/313 |
| 1-54168 | 3/1989 | Japan | 454/313 |
| 4-327753 | 11/1992 | Japan | 454/313 |

*Primary Examiner*—Allen J. Flanigan

[57] ABSTRACT

A rotatable louver assembly (20) for a fan discharge duct (14). The louver assembly has at least two louver slats (21, 22) that are fixed in spatial relationship with respect to each other. A first or upper louver slat (21) has a shape that conforms generally to the shape of a first or upper wall (41) of the discharge duct. The second or lower louver slat (22) has a shape that conforms generally to the shape of a second or lower wall (42) of the discharge duct. The louver assembly has at least two positions. In one position the first louver slat is generally aligned with and spaced from the upper wall to define a generally constant cross-section low loss passageway therebetween for directing air horizontally. In another position the second louver slat is generally aligned with the lower wall to define a generally constant cross-section low loss passageway therebetween for directing the air generally vertically. The assembly may have a third position in which one of the louver slats at least partially blocks the outlet.

13 Claims, 3 Drawing Sheets

LOUVER ASSEMBLY FOR FAN DISCHARGE DUCT

BACKGROUND OF THE INVENTION

This invention relates generally to apparatus for controlling air flow. More particularly the invention relates to a louver assembly for controlling the direction of air exiting the discharge outlet of a fan, such as is in the indoor unit of a duct-free split air conditioning system.

Duct-free split air conditioning systems are usually found in residential and small commercial applications and comprise an outside unit and an indoor unit. Duct-free split systems have a heat exchanger, a fan and the compressor in the outside unit located external to the space to be conditioned. The indoor unit also contains a heat exchanger and a fan. Refrigerant lines run between the indoor and outdoor units and interconnect the two heat exchangers with the compressor. It is common to mount the indoor unit of a duct-free split air conditioner high on a wall, such as near the ceiling.

A duct-free split air conditioner may be reversible. That is, the system may be capable of both cooling and heating the air in the room it serves. During operation in the cooling mode, it is desirable to direct the discharge of cooled, conditioned air horizontally, near the ceiling, since cool air tends to fall. In the heating mode, it is desirable to direct the discharge of heated conditioned air downward into the lower portion of the room to displace the cold air that tends to collect there. This redirection of the air is commonly accomplished by a moveable louver assembly that is operated either manually or automatically. For example, a single louver slat may divide the flow through the fan discharge duct into upper and lower portions. The upper wall of the discharge duct defines an upper flow path portion with the upper surface of the louver slat, and the lower wall of the discharge duct defines a lower flow path portion with the lower surface of the louver slat. The slat is moved from a heating mode, which directs air downwardly, to a cooling mode for directing air horizontally. Since the upper and lower discharge duct walls generally diverge from each other and often have different shapes (e.g. flat or curved), these flow path portions will have different configurations in each mode; and those configurations often result in considerable flow separation from the walls in at least one and often both modes, since flow path shape cannot be optimized for both configurations. Flow separation causes efficiency losses and noise, which are undesirable.

Some prior art rotatable louver assemblies comprise a pair of spaced apart similarly shaped slats. The same flow separation problems occur along the upper and lower channel walls due to the shape of those channels in each of the modes.

An object of the present invention is a louver assembly with reduced flow separation in both the heating and cooling modes as compared to prior art louver assemblies.

SUMMARY OF THE INVENTION

The present invention is a moveable louver assembly within the discharge duct of a fan unit, wherein the assembly has selectively shaped louvers such that, in more than one setting position, the louvers promote smooth, attached air flow through the duct, improving flow performance and contributing to quiet, efficient movement of air through the unit in both settings.

More specifically, the louver assembly has two spaced apart interconnected louver slats extending horizontally between the duct side walls. The assembly (and thus the slats) is rotatably mounted within the discharge duct. A first of the slats has a cross sectional contour conforming generally to the shape of the surface of the downstream portion of the upper wall of the duct. The other slat has a cross sectional contour conforming generally to the shape of the surface of the downstream portion of the lower wall of the duct. The upper wall flow surface of the duct is generally horizontal, and preferably, but not necessarily, flat. The flow surface of the lower wall of the duct preferably curves gently from a somewhat horizontal orientation to a generally vertical orientation. When it is desired to direct air exiting the discharge duct in a generally horizontal direction, as during cooling, the louver slats are rotated to a position wherein the upper slat is adjacent and spaced from the upper flow path surface to define a generally horizontal, constant cross sectional area flow passage therebetween. Simultaneously, the lower slat is more or less horizontally oriented and forms a generally horizontally oriented extension of the lower flow path surface.

When it is desired to direct air exiting the discharge duct in a generally vertical or downward direction, as during heating, the louver slats are rotated to a position wherein the lower slat is adjacent and spaced from the lower flow path surface, following its curvature or shape to define a generally constant cross sectional area flow passage therebetween, which turns and directs the flow downwardly out of the outlet. Preferably, simultaneously, the upper slat also becomes oriented to direct flow generally vertically from the outlet.

With this louver configuration a more optimum, lower loss flow path is formed in both the heating and cooling modes as compared to prior art louver configurations. The louvers promote smooth, attached flow through the outlet whether set in the horizontal or downward air flow mode.

In a preferred embodiment, the louver assembly is set in a third position to serve a cosmetic or aesthetic function when the indoor unit is not operating. In that third position the louver slats are set to at least partially block the discharge outlet and to present a smoother, more finished appearance to the outside of the unit when the unit is not operating.

BRIEF DESCRIPTION OF THE DRAWINGS

The accompanying drawings form a part of the specification. Throughout the drawings like reference numbers identify like elements.

DESCRIPTION OF THE PREFERRED EMBODIMENT

Figure 1:
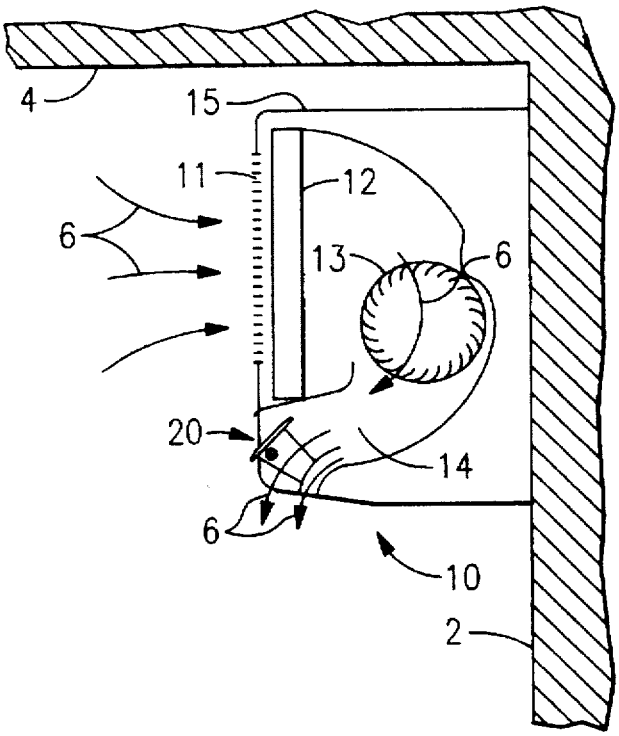
FIG. 1 is a schematic depiction of a wall mounted indoor unit of a duct-free split air conditioning system incorporating the present invention.

FIG. 1 shows indoor unit 10 of a duct-free split air conditioning system mounted on a wall 2 adjacent a ceiling 4. The unit 10 includes a casing 15 enclosing a heat exchanger 12, transverse fan 13, and louver assembly 20. The fan 13 draws air (represented by the arrow 6) from a conditioned space into the unit through the grill of an air inlet 11, and through the heat exchanger 12. The fan 13 blows the air from the unit 10 into the room through a fan discharge duct 14 within which is disposed the louver assembly 20 for directing the air either downwardly (as depicted in FIG. 1) or horizontally, depending upon the position of the assembly.

Figure 2:
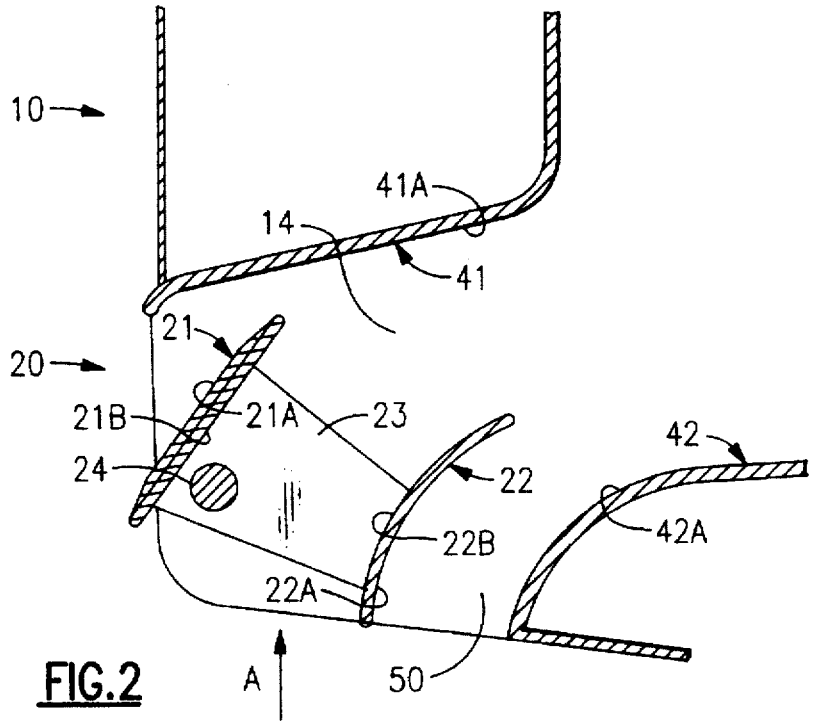
FIG. 2 is an enlarged sectioned view of the fan discharge duct of the unit shown in FIG. 1 with the louver assembly of the present invention positioned to direct air exiting the outlet generally downwardly.
Figure 3:
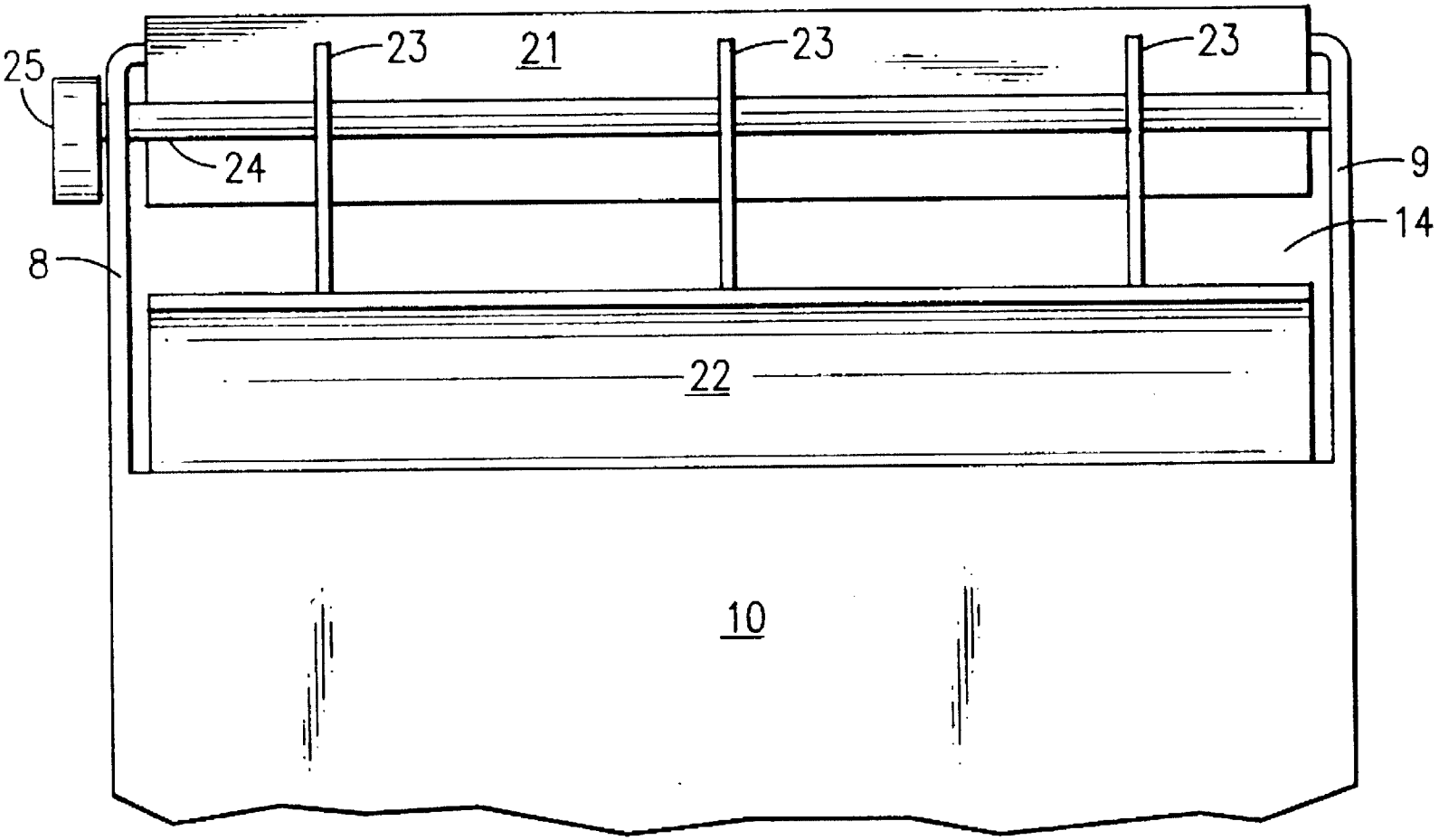
FIG. 3 is a view in the direction A of FIG. 2.

Referring to FIG. 2, the discharge duct 14 has an upper wall 41, lower wall 42, and side walls 8, 9 (FIG. 3). The upper wall 41 has a generally flat, horizontally extending inner surface 41A which defines the upper portion of the discharge outlet. The lower wall 42 is curved and has a curved inner surface 42A which extends from a generally horizontal upstream orientation to a generally vertical downstream orientation, the transition from horizontal to vertical being gradual.

Referring to FIGS. 2 and 3, the louver assembly 20 comprises louver slats 21 and 22 mounted on a shaft 24 extending between and rotatably secured to the fan discharge duct outlet side walls 8 and 9. A control 25 (herein shown as a knob) is used to rotate the louver assembly 20 into its various positions, as described below. The control 25 may also be an automatic or semiautomatic positioning devise. The slat 21 has a generally straight cross section and basically flat opposing surfaces 21A, 21B. The slat 22 has a curved cross section with opposed concave and convex surfaces 22A and 22B, respectively. The curvature of the slat 22 is similar to the curved surface 42A of the lower wall 42. In the mode shown in FIG. 2, the curved surface 22A of the slat 22 is adjacent and spaced from the similarly curved surface 42A of the wall 42 to form a curved outlet passage 50 which has a relatively constant (as opposed to expanding) cross sectional flow area. In this heating mode position the slat 22 turns the air flowing through the outlet 14 in a downward or vertical direction and promotes smooth flow over the surface 42A with little, if any, separation. The flat louver slat 21, in this heating mode, also becomes generally vertically oriented and turns a large portion of the exiting air in a downward direction.

Figure 4:
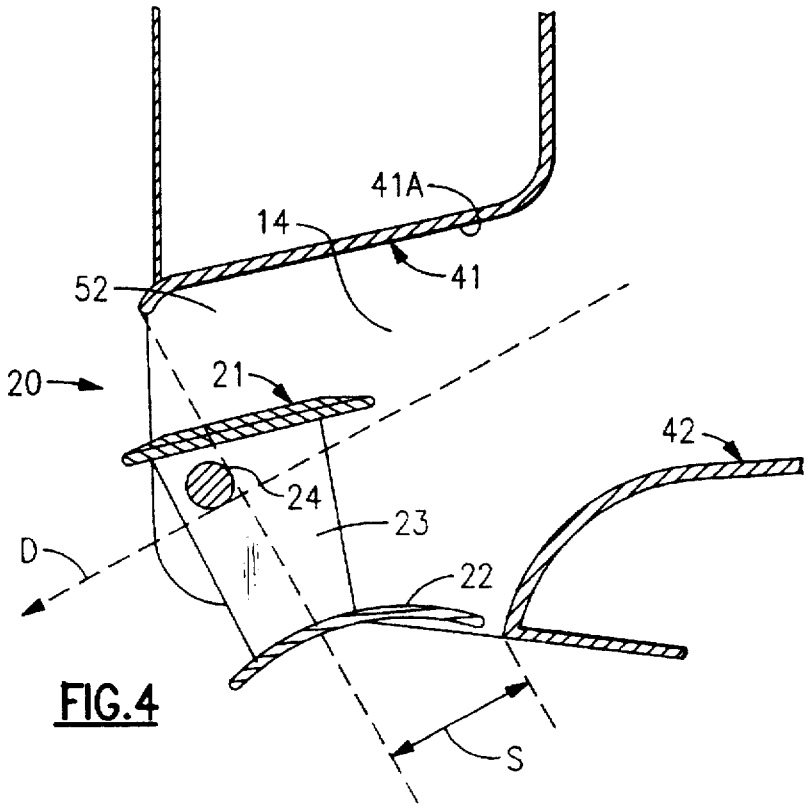
FIG. 4 is an enlarged sectioned view of the fan discharge duct of the unit shown in FIG. 1 with the louver assembly of the present invention positioned to direct air exiting the outlet in a generally horizontal direction.

Referring, now, to FIG. 4, the louver assembly 20 is shown in its cooling mode position. In that position, the flat louver slat 21 is spaced from and generally parallel to the flat surface 41A of the upper wall 41 to define a generally constant cross section flow path 52. Thus, the slat 21 helps direct the air horizontally as it flows from the duct 14, and also promotes smooth, unseparated flow over the surfaces 21A and 41A of the upper wall 41. The curved louver slat 22 is also more horizontally oriented in this mode and, in combination with wall surface 42A, also serves to direct exiting air in a generally horizontal direction.

Figure 5:
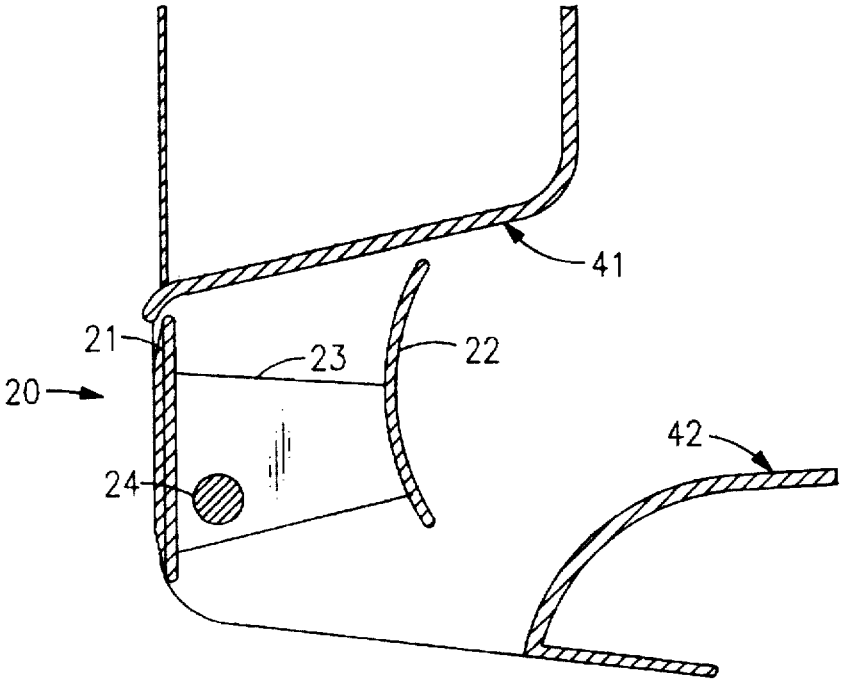
FIG. 5 is an enlarged sectioned view of the fan discharge duct of the unit shown in FIG. 1 with the louver assembly of the present invention positioned for no flow.

When the unit 10 is not operating, the louver assembly 20 may be positioned as shown in FIG. 5 wherein the louver slat 21 blocks the upper portion of the duct outlet and serves to improve the appearance of the unit 10 by presenting a smooth front face. In that position the slats 21 and 22 also serve to restrict the view into the interior of the unit.

A prototype of the louver assembly as described above was made and tested and compared to a single, flat, rotatable louver slat. In the cooling mode of operation there was an air flow increase of eight percent using the louver assembly of the present invention. In the heating mode the present invention provided an air flow increase of fourteen percent. The noise produced by the unit incorporating the present invention and the unit incorporating the prior art was the same. When the fan speed of the unit incorporating the present invention is reduced so as to yield the same air flow rate as that achieved in a unit with the prior art louver configuration, the noise output of the unit is reduced by about one to two dBA. Thus, the present invention can provide either increased air flow for the same fan speed and noise level, or reduced noise by using a slower fan speed, without sacrificing air flow rate. (In the aforementioned comparative tests, modifications were also made to the shape of the upper and lower duct walls 41, 42. However, the great majority of the noted improvements were determined to be achieved through the novel louver assembly of the present invention.)

Note that the upper wall 41 need not be flat. It could have a curvature. In that case the slat 21 would be shaped to have a similar curvature. The key is to have one slat match the shape of the upper wall surface and the other slat match the shape of the lower wall surface, so that in both the heating or cooling mode a flow path is formed which minimizes separation of air flow from the walls.

The invention is particularly advantageous when there is a significant offset between the downstream ends of the upper and lower outlet duct walls 41, 42, the offset being in the general direction that the air flow would take if the louver assembly were absent. That direction is the downstream direction and is depicted by the phantom arrow labeled D. The offset distance is labeled "S" in FIG. 4. It is also preferable that at least 50% of the length of the upper slat 21 be upstream of the downstream end of the upper surface 41A in the cooling mode. Similarly, at least 50% of the length of the lower slat 22 should be upstream of the downstream end of the lower surface 42A when the louver assembly is in the heating mode.

Although in this preferred embodiment the indoor air conditioning unit has a transverse fan, the invention is equally applicable to units with centrifugal or other kinds of fans.

We claim:

1. In a fan unit (10) comprising a discharge duct (14) having an upper wall surface (41A), a lower wall surface (42A), and side walls (8, 9), an improved louver assembly (20) disposed within said duct, said assembly being rotatable between a first position and second position, the improvement comprising:

said louver assembly including an upper slat (21) and lower slat (22) extending across said duct between said side walls, said upper and lower slats being spaced apart, said upper slat having a contour which follows the contour of said upper wall surface and being adjacent thereto and spaced therefrom when said louver is in said first position to define a generally constant cross-section flow passageway (52) therebetween, and said lower slat having a contour which follows the contour of said lower wall surface and is adjacent thereto and spaced therefore when said louver is in said second position to define a generally-constant cross-section flow passageway (50) therebetween.

2. The louver assembly of claim 1 in which said upper louver slat is fixed in spatial relationship with said lower louver slat.

3. The louver assembly of claim 1 in which said upper wall surface is generally flat and horizontal, said upper louver slat is flat, and said lower wall surface has a curvature wherein it transitions smoothly from a generally horizontal orientation to a generally vertical orientation.

4. The louver assembly of claim 1 in which said assembly is rotatable into a third position in which said first louver slat at least partially blocks said outlet.

5. The louver assembly according to claim 1, wherein said upper wall surface and said lower wall surface define a passageway for directing flow in a downstream direction, and wherein said upper wall surface extends a significant distance in the downstream direction further than said lower wall surface.

6. The louver assembly according to claim 4, wherein when said louver assembly is in said first position no more than 50% of the length of said lower slat extends downstream of the end of said lower wall surface, and when said louver assembly is in said second position, no more than 50% of the length of said lower slat extends downstream of the end of said lower wall surface.

7. An improved air conditioning system unit (10) comprising:

a heat exchanger (12);

a fan (6) disposed downstream of said heat exchanger;

a discharge duct (41, 42, 8, 9) downstream of said fan, said duct having an upper wall surface (41A), a lower wall surface (42A) and side walls (8, 9);

a louver assembly (20) disposed within said duct and including a pair of spaced apart slats (21, 22) extending between said side walls, said assembly being rotatable between a first position and second position, the first slat of said pair of slats being an upper slat having a first surface (21A) with generally the same contour as said upper wall surface, and the second slat of said pair of slats being a lower slat having a first surface (22A) with a contour generally the same as said lower wall surface;

wherein said assembly is moveable between a first position wherein said first surface of said upper slat is adjacent and spaced from said upper wall surface to define a generally constant cross section upper outlet passageway (51), and a second position wherein said first surface of said lower slat is adjacent and spaced from said lower wall surface to define a generally constant cross section lower outlet passageway (50).

8. The improved air conditioning unit of claim 7, wherein said lower wall surface of said discharge duct is a curved surface which transitions from a generally horizontal orientation to a generally vertical orientation, and in said assembly second position said first surface (22A) of said lower slat transitions from a generally horizontal orientation to a generally vertical orientation.

9. The improved air conditioning unit of claim 8, wherein said upper wall surface is generally horizontal and flat, and said upper slat first surface is generally flat.

10. The improved air conditioning unit of claim 9, wherein said upper and lower slats are fixed relative to each other.

11. The improved air conditioning system of claim 9, wherein said upper slat is generally flat and has opposed flat surfaces (21A, 21B), and said lower slat is curved and has opposed convex (22B) and concave (22A) surfaces.

12. The improved air conditioning system of claim 9, wherein when said louver assembly is in said second position, said upper slat is oriented to direct flow from said discharge outlet generally vertically, and when said louver assembly is in said first position, said lower slat is oriented to direct flow from said discharge outlet generally horizontally.

13. The improved air conditioning system of claim 8, wherein said fan is a transverse fan.

* * * * *